US007554061B2

(12) United States Patent
Ruther et al.

(10) Patent No.: US 7,554,061 B2
(45) Date of Patent: Jun. 30, 2009

(54) METHOD FOR CONTROLLING THE OVEN TEMPERATURE, AND TEMPERATURE CONTROL UNIT

(75) Inventors: Florian Ruther, Rothenburg (DE); Martin Andersson, Rothenburg (DE); Maike Meider, Rothenburg (DE); Christoph Walther, Rothenburg (DE)

(73) Assignee: Electrolux Home Products Corporation N.V., Zaventem (BE)

( * ) Notice: Subject to any disclaimer, the term of this patent is extended or adjusted under 35 U.S.C. 154(b) by 300 days.

(21) Appl. No.: 11/378,736

(22) Filed: Mar. 17, 2006

(65) Prior Publication Data

US 2006/0231551 A1 Oct. 19, 2006

(30) Foreign Application Priority Data

Apr. 15, 2005 (DE) ..... 10 2005 017 617

(51) Int. Cl.
*H05B 1/02* (2006.01)

(52) U.S. Cl. ..... 219/492; 219/497; 219/505; 99/325

(58) Field of Classification Search ..... 219/412–415, 219/494, 497, 499, 501, 505, 508, 506; 99/325–333
See application file for complete search history.

(56) References Cited

U.S. PATENT DOCUMENTS

| | | | | | |
|---|---|---|---|---|---|
| 5,253,564 | A * | 10/1993 | Rosenbrock et al. | ..... | 99/328 |
| 5,528,018 | A * | 6/1996 | Burkett et al. | ..... | 219/506 |
| 6,150,637 | A * | 11/2000 | Arroubi et al. | ..... | 219/497 |
| 6,232,582 | B1 * | 5/2001 | Minnear et al. | ..... | 219/497 |
| 6,809,301 | B1 * | 10/2004 | McIntyre et al. | ..... | 219/506 |
| 7,041,940 | B2 * | 5/2006 | Bakanowski et al. | ..... | 219/412 |

* cited by examiner

*Primary Examiner*—Mark H Paschall
(74) *Attorney, Agent, or Firm*—Pearne & Gordon LLP

(57) ABSTRACT

Method for controlling the temperature of an oven, in particular a kitchen oven, so as to reach a preset temperature through a heating process during a predetermined heating period based on a control program, said control program consisting of a general basic control program predefined for a given type of oven and computationally adjusted by a static correction value that reflects the individual oven parameters, and/or a dynamic correction variable that takes into account variable operating parameters of the oven.

25 Claims, 2 Drawing Sheets

METHOD FOR CONTROLLING THE OVEN TEMPERATURE, AND TEMPERATURE CONTROL UNIT

This invention relates to a method for controlling the temperature of an oven, in particular a kitchen oven, as well as to a temperature control unit of such an oven for implementing said method, and, finally, to an oven so equipped.

Before an oven can be used it takes a certain amount of time to reach a preset temperature, which time depends, among other factors, on the initial or start temperature, the output of the heating elements, the insulation and the thermal mass or heating capacity of the oven.

An increasing number of modern ovens of the type referred to, meaning in particular kitchen ovens and conventional-oven/microwave-oven combinations, but steam cookers and other oven-like household equipment as well, employ temperature control programs designed to make the preparation of certain meals easier and more reliable. These programs are created for specific types of ovens and are factory-installed in these particular ovens.

It has been found that standard programs of that nature do not in all cases offer the desired degree of temperature-control accuracy and thus a reliable success of the meal preparation process in the oven.

It is therefore the objective of this invention to introduce a method of the general type described above, offering improved accuracy and dependability for the user, as well as a corresponding temperature control unit and, finally, an oven so equipped.

In terms of the methodological aspect this objective is achieved with a method embodying the characteristic features described in claim 1, and in terms of the equipment it is achieved with a temperature control unit offering the characteristic features per claim 15 and with an oven offering the features per claim 21. Practical enhancements of the inventive concept are covered in the dependent claims.

One essential idea that is part of the invention is to develop for a given type of oven a general predefined basic control program which takes into account a correction value that reflects the significant parameters of the individual oven. Specifically, this is an essentially static correction value that adequately reflects the design characteristics in the control program of the individual oven. In that context, the invention also includes the idea of utilizing a cumulative correction value that permits a simple adjustment to the oven characteristics without the costly need for these to be individually measured, entered and computer-processed.

Another part of the invention consists in the relatively independent idea of integrating in the control program a dynamic correction variable or correction formula that permits an adaptation to the actual values of variable operating parameters of the oven. These are operating parameters that are not factory-built into the oven but are relatively easy to quantify 'on site'.

In one preferred implementation of the method, the static correction value is determined in a heating cycle of the empty oven by comparing a measured actual value, specifically the actual heating value, with a reference value contained in the basic control program, in particular the heating reference value. Alternatively, the dynamic correction variable is determined with the aid of a correction (compensation) formula, immediately prior to or during the heating process, from a measured value of at least one operating parameter.

Considering that the heating time is a major element of every method of the type here discussed, the preferred static correction value and/or dynamic correction variable utilized is a heating time difference or a heating rise-path i.e. upslope factor that reflects a deviation of the rise of a corrected heating curve from that of a reference curve as a multiplication factor.

In general, the dynamic correction variable is established taking into account at least one of the operating parameters that include line voltage, starting temperature and energy consumption or power draw. Here, in one advantageous design, the dynamic correction variable is determined by calculating the heating time difference, taking into account all of the operating parameters mentioned i.e. line voltage, starting temperature and energy consumption or power draw, using a regression analysis method and a polynomial correction or compensation formula. This compensation formula is generally predefined for a given type of oven and is part of the algorithm of the basic control program.

According to a relatively independent partial aspect of the invention, a control value, especially the time of heating to a predefined temperature, is displayed continuously. This display of the time remaining until the desired temperature is reached gives the user highly useful information for planning certain work-flow steps.

It will be desirable for determining the energy consumption or power draw, apart from the line voltage, to measure the oven current. In one practical, relatively independent variation of the method involving the detection of the dynamic energy consumption or power draw, the energy consumption is determined during a complete temperature control cycle, especially during the complete heating cycle, and the value thus determined is displayed and/or stored in memory.

In this fashion it is possible to determine and display or process the energy consumption information for instance during an entire baking cycle or during other preselected time segments and especially even during the entire life of the oven. To that effect the energy consumption or power draw information is stored according to one or several specific memory protocols and the stored data will be maintained in a manner as to be conveniently accessible via different retrieval modes. On that basis even the energy cost can be displayed if in addition the energy price is entered.

Another relatively independent variation of the aforementioned temperature control provides for a reference value of the energy consumption or power draw to be stored in memory and subjected to a threshold discrimination operation comparing it with the actual energy consumption or actual power draw, triggering an error signal in the event a preset differential threshold value is exceeded. This advantageous implementation permits the future detection of heating elements that have become defective, enabling the user to call for appropriate repair services.

From the above-described determination of the energy consumption during past operating cycles of the oven another, relatively independent functionality of the inventive method can be derived: The cumulative energy consumption data, stored via a summation routine, from consecutive temperature control programs can be compared against an energy consumption reference total, so that upon reaching that reference total an advisory signal can be released via a user interface or a cleaning control signal can be triggered. This will alert the user to the operation-related need, as it arises over time, for a cleaning. In principle it would be possible to automatically trigger a cleaning program; however, it will be more practical to have that initiated by the user.

According to another, relatively independent concept it is possible, via a user interface or an external interface in conjunction with the invention, to modify an algorithm and/or input and/or output variable for the determination of the static and/or dynamic correction value. In addition to a basic configuration of correction values this will permit the implementation—depending on oven models with different convenience features and in different price categories but also for retrofits—of additional correction values or of an enhanced compensation mode.

In yet another relatively independent variation of the novel method, the value of a parameter derived from the control program as adjusted by the static and/or dynamic correction value, specifically the heating time at a preset temperature or heating rise path, is stored and is subjected to a threshold discrimination operation comparing it with the corresponding value of earlier program cycles, and an error signal is emitted in the event a predefined threshold differential is exceeded.

This permits the detection, and indication to the user, especially of insulation flaws that are above and beyond normal signs of aging, affecting oven performance and substantially increasing energy consumption. The user can then arrange for an appropriate inspection of the insulation. Moreover, it enables the user even in the initial phase of the heating cycle s/he had set in motion to see whether or not the oven has been loaded. If that is not the case, sounding the aforementioned error signal can alert the user to the erroneous activation of the heating cycle or to the fact that s/he forgot to place food in the oven.

Preferred embodiments of the temperature control unit according to the invention and of the oven so equipped employ the above-described methodological aspects as characterizing design features to which specific reference is made.

Accordingly, a major component of the inventive temperature control unit consists in a correction stage for calculating the static correction value and/or the dynamic correction variable into the development of the control program. The control unit additionally encompasses a program memory module for storing the control program derived with the correction value or values or a corrected control value for linking it to the basic control program. Also, provisions will typically be made for the (buffer) storage of the relevant values of the correction variable(s).

Preferred embodiments of the temperature control unit will also include a reference-value memory module for storing a reference value of the control variable whose comparative processing produces the relevant value of the correction variable, as well as a measuring device for measuring the actual values of the control variable concerned. The comparative processing takes place in a processing unit which in this particular embodiment constitutes the main element of the correction stage.

Other preferred forms of implementation include a user interface or an external interface permitting the modification of the basic control program or of an algorithm and/or of input/output variables for the determination of the static and/or dynamic correction value. Of course, a user interface of that nature includes suitable input provisions. Moreover, the novel temperature control unit encompasses a controller designed specifically for the dynamic-correction version of the control program and serving to initiate and guide the correction process and the storage of the new control program.

The inventive oven as well employs the above-described methodological aspects as characterizing system features to the extent that they do not directly pertain to the generation and implementation of the control program but to peripheral processes.

Specifically, the oven according to the invention incorporates suitable measuring devices serving to quantify the operating parameters by means of which the actual value of the control variable is measured to allow the determination of the static correction value or of the actual values of the dynamic correction variable. In preferred embodiments these devices are in the form of a heating time measuring device or a line voltage measuring device and/or a temperature measuring device and/or an energy consumption or power draw measuring device (which on its part includes beside the voltage measuring provision a current measuring device).

In a preferred embodiment that permits the display of energy consumption information for the user, the oven comprises an additional feature, connected in line with the energy consumption or power draw measuring device, in the form of an energy-data storage and/or display unit especially of a version controllable by several storage routines for storing, or displaying stored and measured, actual energy consumption or actual power draw data. In another practical, independent design implementation that permits easy identification of certain oven defects, the oven incorporates an energy reference-value memory module for storing an energy consumption or power draw reference value, and, connected to the energy reference-value memory and the energy-data storage unit, a discriminator stage for executing a threshold-value discrimination operation and for emitting an error signal if a predefined differential threshold between the actual energy consumption and the energy reference value is exceeded.

Another advantageous configuration that allows other oven defects to be detected and flagged to the user in practical and simple fashion, incorporates a control variable memory module with several memory areas serving to store several values representing actual control-variable values derived during temperature control processes, as well as a comparator unit, associated with the control variable memory, for comparing the actual values thus derived, which comparator is designed as a discriminator stage that triggers an error signal when a preset threshold differential between the stored actual values is exceeded.

Other innovative functional enhancements to conventional oven designs through the above-described methodological aspects are attainable with essentially conventional hardware (processing, memory and display modules) and with implementation software based on the said methodological aspects.

Advantageous and expedient features of the invention in its various aspects will also be evident from the following description with reference to the illustrations of which:

Figure 1:
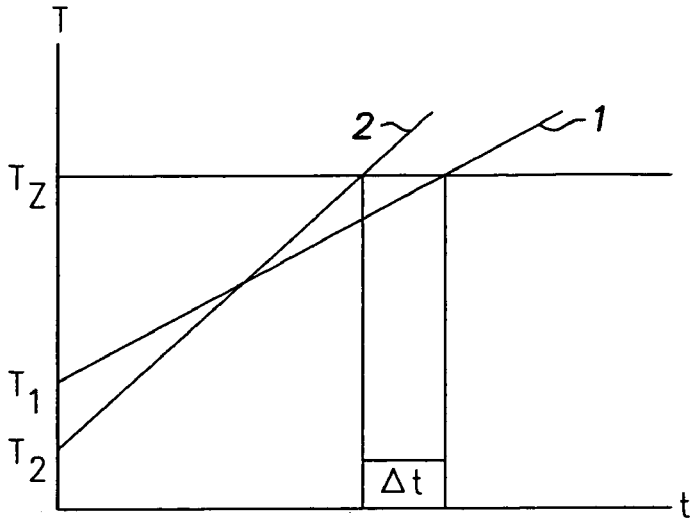
FIG. 1 is a schematic graph explaining the correction concept in a first embodiment of the invention.

FIG. 1 is a diagrammatic illustration of a temperature-time plot in which a straight line 1 represents a heating curve of a kitchen oven with a first set of operating parameters (starting temperature $T_1$, first operating voltage and first energy consumption), and a straight line 2 represents a heating curve derived from a set of actual operating parameters (actual starting temperature $T_2$, actual line voltage and actual energy consumption). As can be seen, there is a heating-time difference $\Delta t$ between a desired heating temperature (target temperature) $T_z$ and the actual value. Taking this heating-time difference into account in the predefined target temperature as part of a basic control program for the heating process will thus reflect the actual values of the operating parameters, allowing for a reasonable correction of the basic control program. This obviates the need for regulating the line voltage or power draw (in terms of keeping them constant) or of the starting temperature for the heating process while at the same time achieving a high level of accuracy and dependability of the program control system.

The heating-time difference can be calculated using regression-analysis methods that deliver a formula that compensates for variations in the starting temperature, line voltage and energy consumption or power draw of the oven. The precise compensation formula depends on the oven configuration and can be derived by those skilled in the art on the basis of the main design parameters.

In addition to the operating parameters mentioned, one has the option of also including other, appropriately weighted parameters in the compensation formula. Inaccuracies resulting from the regression analysis do not negate its use for basic control-program correction. Moreover, the compensation formula established for a particular oven model can be applied with adequate accuracy to all ovens of that specific type and can therefore be embedded in the basic control program.

Figure 2:
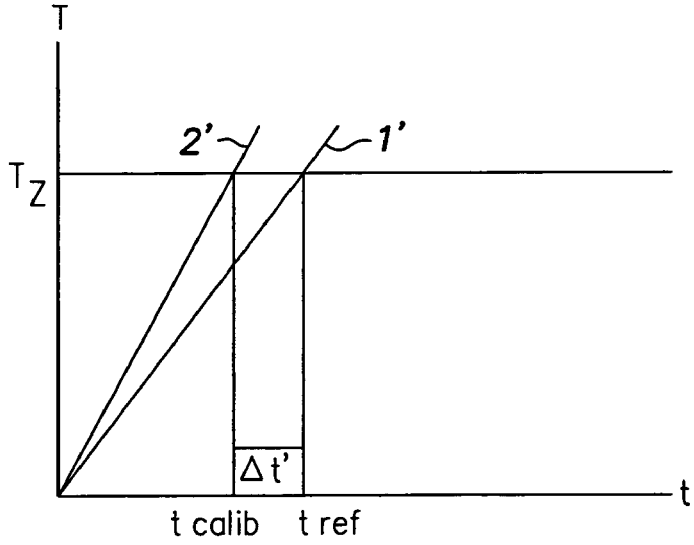
FIG. 2 is a schematic graph explaining the correction concept in a second embodiment of the invention.

The illustration in FIG. 2 is similar to that in FIG. 1 but reflects a different form of implementation of the invention in that a static correction value for a heating control program for a specific individual oven is obtained through a calibration measurement. In this illustration, the straight line 1' represents a reference heating-time curve of an oven designed with standard thermal properties, on which the selection of a basic control program is determined, while the straight line 2' reflects the heating pattern, established by appropriate measurements, of a specific individual oven. In this case, for simplicity's sake, the starting temperature has been assumed to be zero.

This graph as well shows a heating time difference $\Delta t'$ relative to a target temperature $T_z$. However, here the time difference does not reflect variable operating parameters but deviations of the static thermal parameters of a specific individual oven from the standard parameters assumed in the basic control program. These deviations can be adequately compensated for via the heating time difference $\Delta t'$ for the specific individual oven without the need to individually measure and computer-process the relevant thermal parameters.

Figure 3:
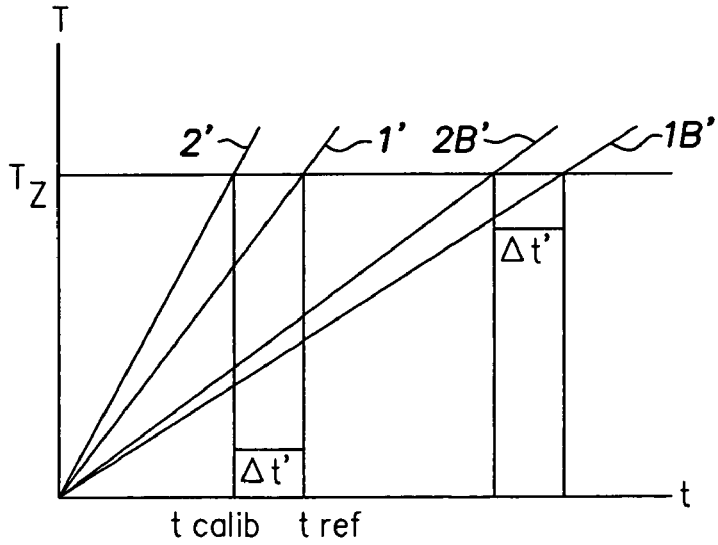
FIG. 3 is another graph explaining the second implementation example.

FIG. 3 is an expanded illustration of the graph per FIG. 2 and includes heating curves 1B' and 2B' of a loaded standard oven i.e. of a specific individual loaded oven for which the heating curve 2' was established in the empty state. For the loaded oven as well, the deviation of the heating characteristic from that of the reference oven can be adequately compensated for via the heating-time difference $\Delta t'$. This means that, regardless of any loading with specific foods, taking the heating-time differential correction value into account allows the temperature control program of the oven to be derived from the basic control program with sufficient accuracy.

The calibration process is based on a linear model of the heating phase, with the slope of the heating curve (the straight line 1' or 2') depending on the thermal mass M of the oven. That thermal mass consists of the thermal mass of the oven itself and that of the loaded food. It should again be noted that this simplified model does not precisely reflect the actual thermal conditions, but it serves as a means to address the effect of the insulation and the specifics of the heating elements with adequate accuracy as thermal mass aspects within the framework of this model. Measuring the heating time difference between the reference oven and a specific individual unloaded oven provides a value that is adequate for taking into account the static thermal parameters in any state of use of the oven.

Figure 4:
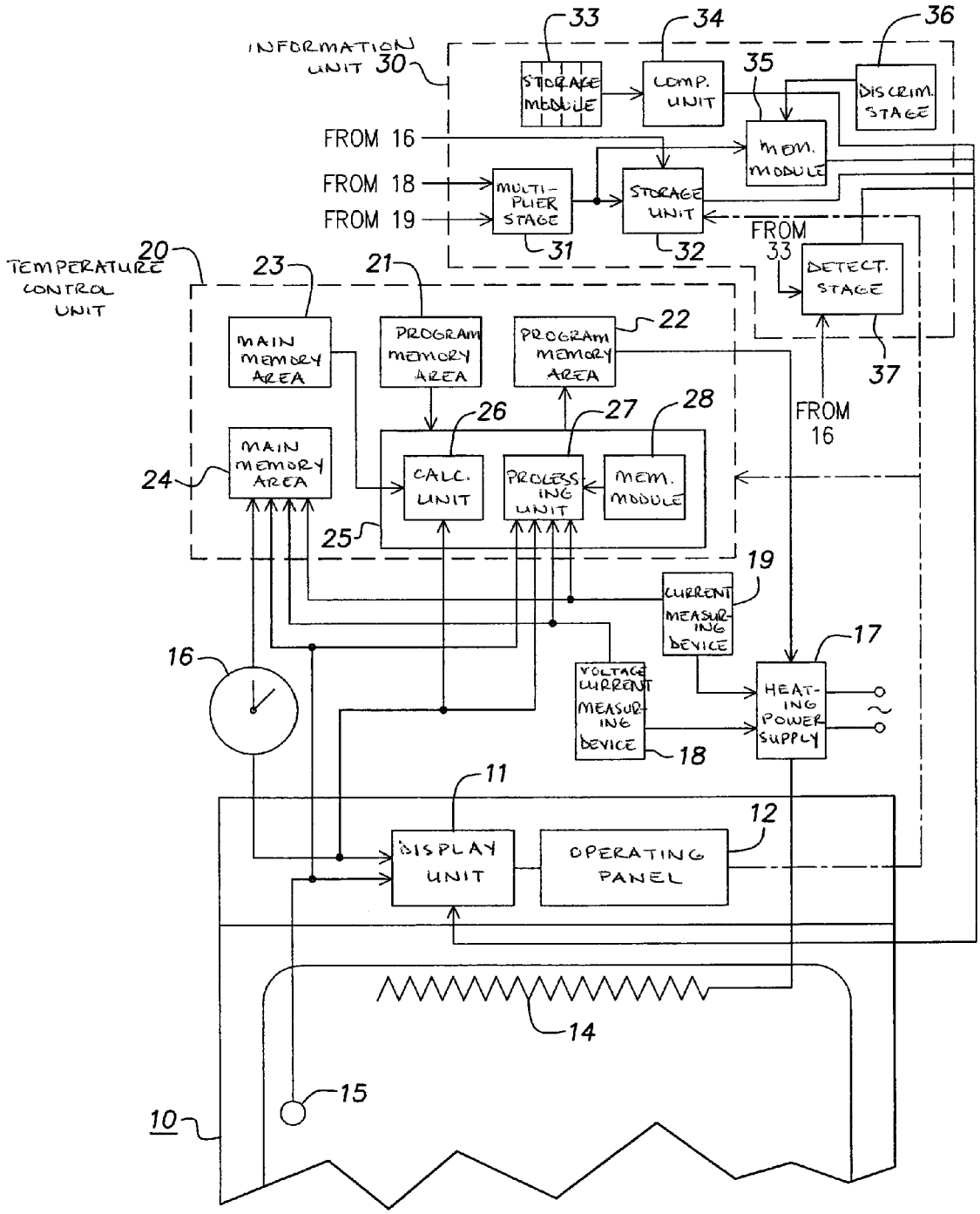
FIG. 4 is a conceptual block diagram explaining a preferred design of an oven according to this invention.

FIG. 4 is a schematic illustration showing the essential functionalities of an oven 10 according to one embodiment of the invention and in particular of its temperature control unit 20. Of the oven 10 itself the figure shows a display unit 11 and an operating panel 12 as well as the upper section of the baking chamber 13 with a heating element 14 and a baking-chamber temperature sensor 15. Also illustrated is a real-time clock 16 with a timer and stop function (not identified by a reference number).

The heating element 14 connects to a heating power supply 17 with associated voltage measuring device 18 and current measuring device 19 constituting transducers for relevant operating parameters, measuring the actual line voltage and the oven current flowing through the heating elements. The temperature control unit 20 connects at its input end to the operating panel 12, the baking-chamber temperature sensor 15, the real time clock 16 and the voltage and current measuring devices 18, 19, and at its output end to the heating power supply 17.

The main function elements of the temperature control unit 20 include a first program memory area 21 for a factory-installed basic control program, a second program memory area 22 for storing a currently valid control program for the specific individual oven 10, a first main memory area 23 for storing reference values of the significant operating parameters and control variables and a second main memory area 24 for storing the respectively current values of the operating parameters and control variables, as well as a correction stage 25.

The input connections of the temperature control unit 20 lead to the correction stage 25 whose output end connects to the second program memory area 22. The correction stage 25 comprises a calculation unit 26 for calculating the static correction value and a processing unit 27 for computing the dynamic correction variable from the measured operating parameters, and, finally, a compensation-formula memory module 28 for storing the compensation formula on which the determination of the dynamic correction variable is based.

The calculation unit 26 connects at its input end to the real-time clock 16 and to the first main memory area 23, while the processing unit 27 connects at its input end to the measuring devices 15, 18 and 19 and, optionally, to the first main memory area and/or to the second main memory area (for the possible inclusion of reference values of the significant operating parameters or of buffered values in the determination of the applicable dynamic correction variable). With regard to the interaction and functionality of the aforementioned memory modules and processing devices of the correction stage 25, attention is invited to the above explanations of the method according to this invention. It should be pointed out that this is merely a conceptual illustration of one embodiment of the invention from which those skilled in the art can derive the details of implementation.

Apart from the aforementioned components of the oven 10 and of the temperature control unit 20, the oven is equipped with an information unit 30 whose input connections correspond to those of the temperature control unit 20 and its output end connects to the display unit 11, while also serving to provide additional data as well as warnings for the user. In the design example of the oven 10 shown, the information unit 30 includes a multiplier stage 31 for oven power-draw determinations, which stage connects to the voltage measuring device 18 and the current measuring device 19. It also includes, connected in line with the said stage and to the real-time clock 16, an energy data storage unit 32 with a differentiated predefined memory structure that permits programming and querying via the operating panel 12 to permit the display of the energy consumption registered in specific operating phases of the oven.

The information unit 30 further includes a control-variable storage module 33 with several memory areas for filing heating-time values in table-format correlation with particular target temperatures. It in turn connects to a comparator unit 34 for the periodic automatic call-up and mutual comparison of stored heating-time values and for emitting an error signal, via the display unit 11, in the event of unacceptably large deviations suggesting a defect in the oven.

The information unit 30 also includes an energy reference-value memory module 35 that connects to one input port of an energy discriminator stage 36 whose other input port connects to the multiplier stage 31 and which serves to execute a threshold-value discrimination operation comparing the actual power draw of the oven 10 with a factory-installed reference value. Upon detection of an unacceptably large deviation between the two values the energy discriminator stage 36 will emit for the user a warning or error signal via the display unit 11 of the oven.

The information unit 30 further includes a residual-time detection stage 37 whose input end connects to the real-time clock 16 and to the control-variable memory 33, whose output end connects to the display unit 11, and which serves to continuously monitor the remaining heating time during the oven operation This invention is not limited to the above-described aspects of the temperature control method and the associated correction (compensation) feature or to the related description of a design example of an oven but is equally implementable in numerous method- and device-related variations. In particular, all technically sensible combinations of any of the characteristic features claimed are to be viewed as being within the patent-protected scope of this invention.

LIST OF REFERENCE NUMBERS

10 oven
11 display unit
12 operating panel
13 baking chamber
14 heating element
15 baking-chamber temperature sensor
16 real-time clock
17 heating power supply
18 voltage measuring device
19 current measuring device
20 temperature control unit
21,22 program memory areas
23,24 main memory areas
25 correction stage
26 calculating unit
27 processing unit
28 compensation-formula memory
30 information unit
31 multiplier stage
32 energy-data storage unit
33 control-variable memory
34 comparator unit
35 energy reference-value memory
36 energy discriminator stage
37 residual-time detection stage

The invention claimed is:

1. Method for controlling the temperature of an oven (10), in particular a kitchen oven, so as to reach a preset temperature (Tz) through a heating process during an appropriate heating period based on a control program, said control program is composed of a general basic control program predefined for a given type of oven and computationally adjusted by a static correction value (Δt) that reflects the individual oven parameters, and/or a dynamic correction variable (Δt') that takes into account variable operating parameters of the oven, a heating-time difference between the preset temperature (Tz) and an actual temperature value of a heating upslope factor reflecting a deviation of the rise of a heating curve from that of a reference curve as a multiplication factor is used as the static correction value (Δt) and/or the dynamic correction variable (Δt'), and a calibration process is based on a linear model of the heating phase.

2. Method as in claim 1, wherein the static correction value (Δt) is determined in a heating process of the empty oven by comparing a measured heating-time value with a heating-time reference value contained in the general basic control program.

3. Method as in claim 1, wherein the dynamic correction variable (Δt') is determined from the measured value of at least one operating parameter directly before or during the heating process.

4. Method as in claim 1, wherein the dynamic correction variable (Δt') is established by taking into account at least one of the operating parameters consisting of line voltage, starting temperature and energy consumption or power draw.

5. Method as in claim 4, wherein the dynamic correction variable (Δt') is calculated in a regression-analysis process on the basis of the heating-time difference, taking into account the operating parameters consisting of line voltage, staffing temperature and energy consumption or power draw, and utilizing a compensation formula of the polynomial type, said compensation formula generally being predefined for a particular type of oven.

6. Method as in claim 1, wherein a control variable, a variable derived from the control variable, or the heating time remaining until a preset temperature is reached, is continually displayed.

7. Method as in claim 4, wherein the line voltage, and measured oven current are used for determining the energy consumption or power draw.

8. Method as in claim 4, wherein the energy consumption or power draw is determined during a complete temperature control cycle, in particular during the complete heating process, and the value thus determined is fed to a display and/or stored in memory.

9. Method as in claim 8, wherein the energy consumption or power draw value is stored in accordance with one or several predefined storage protocols and the content of the memory is kept accessible in accordance with at least one retrieval protocol corresponding to the storage protocol.

10. Method as in claim 8, wherein an energy consumption or power draw reference value is stored in the memory and is subjected to a threshold discrimination process comparing the stored energy consumption or power draw reference value with the determined energy consumption or power draw, and that an error signal is emitted when a predefined differential threshold value is exceeded.

11. Method as in claim 8, wherein a total energy consumption value accumulated from consecutive temperature control programs and stored in accordance with a summation protocol is compared with a summary energy consumption reference value and that upon reaching said summary reference value a corresponding information signal appears on a user interface or a cleaning control signal is triggered.

12. Method as in claim 1, wherein for determining the static and/or dynamic correction values (Δt, Δt') an algorithm and/ or input and/or output values can be modified via a user interface or an external interface.

13. Method as in claim 1, wherein the value of a parameter, especially the time of heating to a preset temperature or heating-time upslope, derived from the control program as adjusted based on the static and/or dynamic correction value (Δt, Δt'), is stored and is subjected to a threshold-value discrimination process for a comparison with the corresponding value of earlier program sequences, and that an error signal is emitted when a predefined threshold-value difference is exceeded.

14. Temperature control unit (20) for implementing a method for controlling the temperature of an oven (10), in particular a kitchen oven, so as to reach a preset temperature (Tz) through a heating process during an appropriate heating period based on a control program, the control program being composed of a general basic control program predefined for a given type of oven and computationally adjusted by a static correction value (Δt) that reflects the individual oven parameters, and/or a dynamic correction variable (Δt') that takes into account variable operating parameters of the oven, a heating-time difference between the preset temperature (Tz) and an actual temperature value or a heating upslope factor reflecting a deviation of the rise the temperature control unit comprising:

a first program memory area (21) serving to store the general basic control program, a correction stage (25) for computationally taking into account the static correction value and/or the dynamic correction variable in establishing the control program, and a second program memory area (22) for storing the control program resulting from the correction value or values, or a corrected control variable for linking the control program to the general basic control program.

15. Method as in claim 1, wherein the heating upslope factor reflects the deviation of the rise of a corrected heating curve from that of the reference curve as the multiplication factor.

16. Temperature control unit as in claim 14, wherein the correction stage (25) is provided with a reference-value storage unit (23) for storing a control variable reference value, and a calculating unit for calculating the static correction value from the control variable reference value and a measured actual value, with the output of the calculating unit connecting to an input of the second program memory area.

17. Temperature control unit as in claim 16, wherein the calculating unit includes a subtraction stage for establishing as the static correction value a heating-time difference from a heating-time reference value and an actual heating-time value.

18. Temperature control unit as in claim 14, wherein the correction stage (25) includes a processing unit with at least one operating-parameter input for computing the dynamic correction variable from at least one of the operating parameters consisting of line voltage, starting temperature and energy consumption or power draw, by employing a polynomial compensation formula and a regression analysis procedure.

19. Temperature control unit as in claim 18, wherein the correction stage (25) includes a compensation-formula memory module (28) that connects to one input of the processing unit and serves to store a general compensation formula predefined for a given type of oven.

20. Temperature control unit as in claim 14, further comprising a user interface (12) or an external interface for modifying the general basic control program and/or an algorithm and/or input and/or output variables for the determination of the static and/or dynamic correction value.

21. Oven (10), in particular a kitchen oven, comprising:

a temperature control unit (20) for implementing a method for controlling the temperature of the oven (10) so as to reach a preset temperature (Tz) through a heating process during an appropriate heating period based on a control program, the control program being composed of a general basic control program predefined for a given type of oven and computationally adjusted by a static correction value (Δt) that reflects the individual oven parameters, and/or a dynamic correction variable (Δt') that takes into account variable operating parameters of the oven, a heating-time difference between the present temperature (Tz) and an actual temperature value or a heating upslope factor reflecting a deviation of the rise of a heating curve from that of a reference curve as a multiplication factor is used as the static correction value (Δt) and/or the dynamic correction variable (Δt') , a calibration process is based on a linear model of the heating phase, the temperature control unit comprising:

a first program memory area (21) serving to store the general basic control program, a correction stage (25) for computationally taking into account the static correction value and/or the dynamic correction variable in establishing the control program, and a second program memory area (22) for storing the control program resulting from the correction value or values, or a corrected control variable for linking the control program to the general basic control program, the oven further comprising a control-variable measuring device (16), serving to quantify the actual value measured for determining the static correction value, specifically a heating-time measuring device, and/or an operating-parameter measuring device (15, 18, 19) for measuring the actual value of an operating parameter used in determining the dynamic correction variable, in particular a voltage measuring device and/or a temperature measuring device and/or an energy-consumption or power-draw measuring device, which control-variable or operating-parameter measuring device is connected to an input of the correction stage (25) of the control unit (20).

22. Oven as in claim 21, wherein the energy-consumption or power-draw measuring device includes a line voltage measuring device (18) and an oven current measuring device (19) and a multiplier stage (31) connected to respective outputs of the line voltage measuring device and the oven current measuring device.

23. Oven as in claim 21, further comprising, connected in line with the energy consumption or power draw measuring device (18, 19, 31), an energy-data storage unit (32) specifically controllable via several storage protocols, and/or a display unit (11) for storing or, respectively, displaying a measured and stored actual energy-consumption or actual power-draw value.

24. Oven as in claim 21, further comprising an energy reference-value memory module (35) for storing an energy-consumption or power-draw reference value, and, connected to the energy reference-value memory and the energy-data storage unit (32), an energy discriminator stage (36) for executing a threshold-value discrimination process and for outputting an error signal in the event a predefined differential threshold value between the actual energy consumption and the energy reference value is exceeded.

25. Oven as in claim 21, further comprising a control-variable memory (33) with several memory areas for storing several values representing the actual values of the control variable as detected during temperature control operations, and, associated with the control-variable memory, a comparator unit (34) for comparing the actual values detected, which comparator is in the form of a discriminator stage that emits an error signal in the event a predefined threshold-value difference between stored actual values is exceeded.

* * * * *